US005673494A

United States Patent [19]

Pham

[11] Patent Number: 5,673,494

[45] Date of Patent: Oct. 7, 1997

[54] HEAT PROTECTOR VISOR

[76] Inventor: Paul Pham, 2021 S. Highway 288B, Angleton, Tex. 77515

[21] Appl. No.: 631,582

[22] Filed: Apr. 12, 1996

[51] Int. Cl.[6] ..... A45D 25/00

[52] U.S. Cl. ..... 34/96; 34/100

[58] Field of Search ..... 34/96, 99, 97, 34/100; 2/174, 204, 209, 3, 171

[56] References Cited

U.S. PATENT DOCUMENTS

| | | | |
|---|---|---|---|
| 2,136,039 | 11/1938 | Clancy | 34/99 |
| 2,226,956 | 12/1940 | Womack | 2/174 |
| 2,323,515 | 7/1943 | Cary et al. | 2/174 |
| 4,133,052 | 1/1979 | Hodgman et al. | 2/174 |
| 4,223,407 | 9/1980 | Zappala | 2/174 |
| 4,704,744 | 11/1987 | Myers | 2/174 |
| 4,934,068 | 6/1990 | Curlee | 34/99 |
| 5,099,524 | 3/1992 | Linday | 2/181 |

*Primary Examiner*—Henry A. Bennett
*Assistant Examiner*—Dinnatia Doster
*Attorney, Agent, or Firm*—Michael I. Kroll

[57] ABSTRACT

A heat protector visor (10) comprising an arcuate panel (12) to fit against a forehead (13) on a head (14) of a person 16. A bill (18) projects forwardly and curves upwardly from the arcuate panel (12). A structure (20) on the arcuate panel (12) is for gripping sides of the head (14) of the person (16). When the person (16) sits under a portable electric hair dryer (22), the upwardly curved bill (18) will deflect heated air (24) away from a face (26) of the person (16), back up into an air chamber (28) of the portable electric hair dryer (22) and onto hair (30) on hair rollers (31) upon the head (14) of the person (16). The heated air (24) will be maximized to dry the hair (30) much faster, reduce operating time and electricity needed to operate the portable electric hair dryer (22).

1 Claim, 3 Drawing Sheets

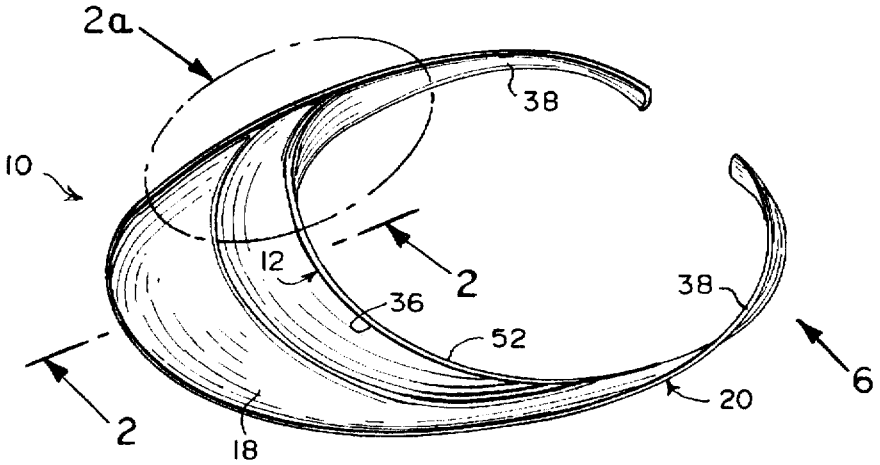
Fig. 1
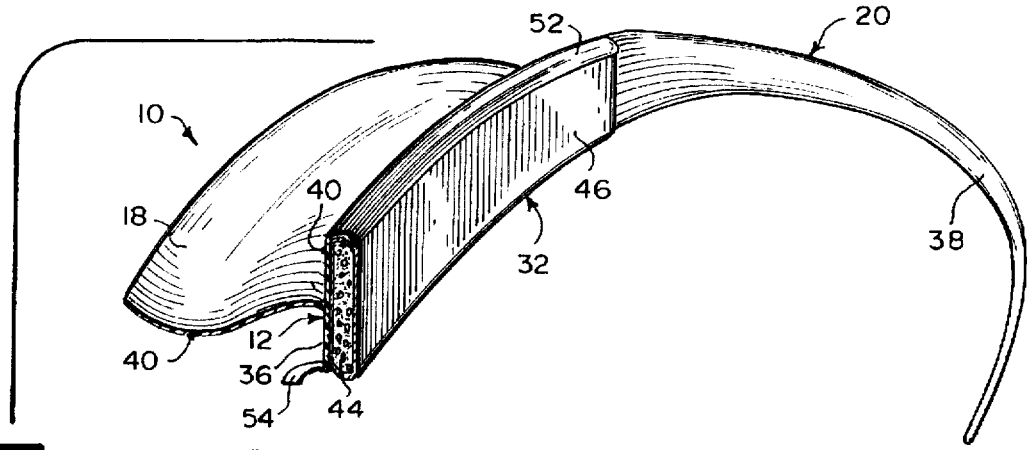
Fig. 2
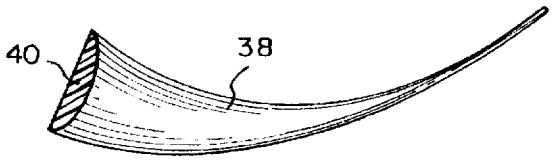

HEAT PROTECTOR VISOR

BACKGROUND OF THE INVENTION

1. Field of the Invention

The instant invention relates generally to headgear and more specifically it relates to a heat protector visor.

2. Description of the Prior Art

Numerous types of headgear have been provided in prior art. For example, U.S. Pat. Nos. 4,630,317 to Brown et al.; 5,046,195 to Koritan; 5,170,808 to Vild et al. and 5,325,540 to Kronenberger all are illustrative of such prior art. While these units may be suitable for the particular purpose to which they address, they would not be as suitable for the purposes of the present invention as heretofore described.

BROWN, LARRY L.

LISLE, JERRY H.

Sweat Band Apparatus

U.S. Pat. No. 4,630,317

A sweat band made of a moisture absorbing material is shaped to fit around the head of a person and has strips of hook and loop material attached thereto for attaching a sun visor or cap. The sun visor has a concave curved portion shaped to fit the forehead of the user and a strip of hook and loop material attached to the visor curved portion, so that a molded plastic visor can be attached and detached as needed by the user. The cap has a portion removed from the rear crown and sweat band. A moisture absorbing sweat band is removably attached to the cap's sweat band with hook and loop material. The moisture absorbing sweat band is elasticized and can expand in the removed portion of the crown and cap sweat band.

KORITAN GILBERT

Headband with Neck Shield

U.S. Pat. No. 5,046,195

An elastic head band is provided with a depending neck shield to protect the wearer's neck from sunburn. The head band may be worn in conjunction with a cap. The neck shield without the head band may be detachably connected to the rear of a cap.

VILD, PATRICIA A.

Acid Perm Method

U.S. Pat. No. 5,170,808

In acid perms, the moist hair while still wet from a shampoo is wound around curling rods and saturated with an acid perm solution. A band or strip of absorbent cotton is placed across the forehead below the hair line. The rim of a visor is mounted on the band and held in place by the lower end of a plastic bag tightened around the head and fastened in place. A preheated hair dryer is lowered over the bag and the heat from the dryer releases acid fumes which are held in contact with the hair until the perm is set. The band absorbs any seepage. The visor protects the eyes from acid fumes. Result: a better perm with no skin or eye irritation.

KRONENBERGER, ROBERT A.

Headwear Pierce with Crown Opening

U.S. Pat. No. 5,325,540

A headwear piece with a crown for placement on the head of a wearer and having a front and rear and a top and bottom.

The crown grips the head of the wearer to maintain the headwear piece in place. The crown has a front wall with a forwardly facing surface. The front wall blends into a top wall that extends rearwardly and terminates at an edge that bounds an opening in the crown through which a substantial portion of a wearer's head can be exposed with the headwear piece in place on a wearer's head. The top wall edge extends from the front of the crown no more than two-thirds, and more preferably no more than one-half, the distance between the front and the rear of the crown.

SUMMARY OF THE INVENTION

A primary object of the present invention is to provide a heat protector visor that will overcome the shortcomings of the prior art devices.

Another object is to provide a heat protector visor with an upwardly curved bill that will deflect heated air away from a face of a person sitting under a portable electric hair dryer.

An additional object is to provide a heat protector visor in which the upwardly curved bill will force the heated air back up into an air chamber of the portable electric hair dryer and onto the hair, so that the heated air from the hair dryer will be maximized to dry the hair much faster, reducing the operating time and electricity needed to operate the hair dryer.

A further object is to provide a heat protector visor that is simple and easy to use.

A still further object is to provide a heat protector visor that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front top perspective view of the instant invention.

Figure 2A:
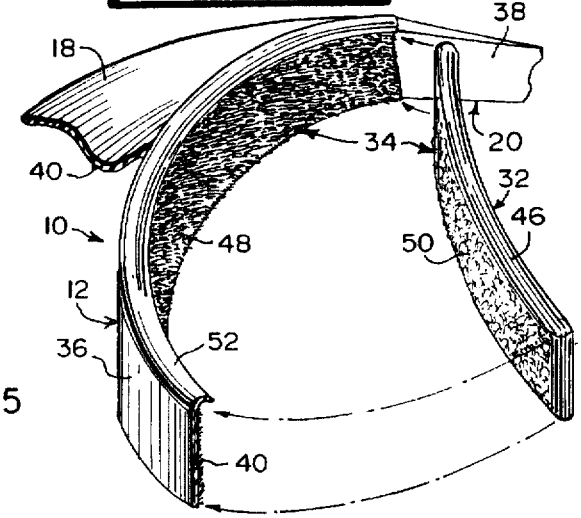
FIG. 2 is an enlarged front top perspective view partly in section as indicated by arrows 2—2 in FIG. 2.

FIG. 2*a* is an enlarged front top perspective view of an area of FIG. 1 as indicated by arrow 2*a* in FIG. 1, with the heat insulator pad exploded therefrom.

Figure 3:
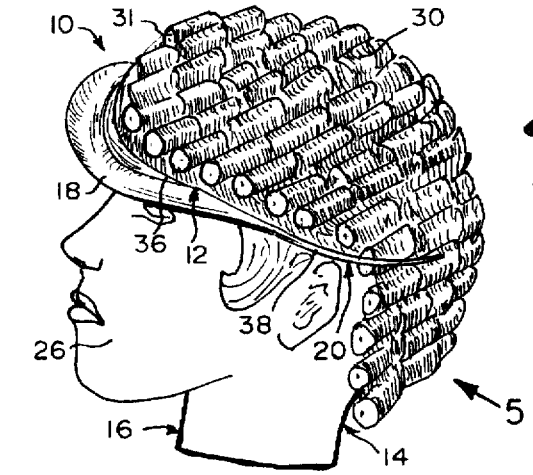

FIG. 3 is a top front perspective view of a head of a person wearing the instant invention.

Figure 4:
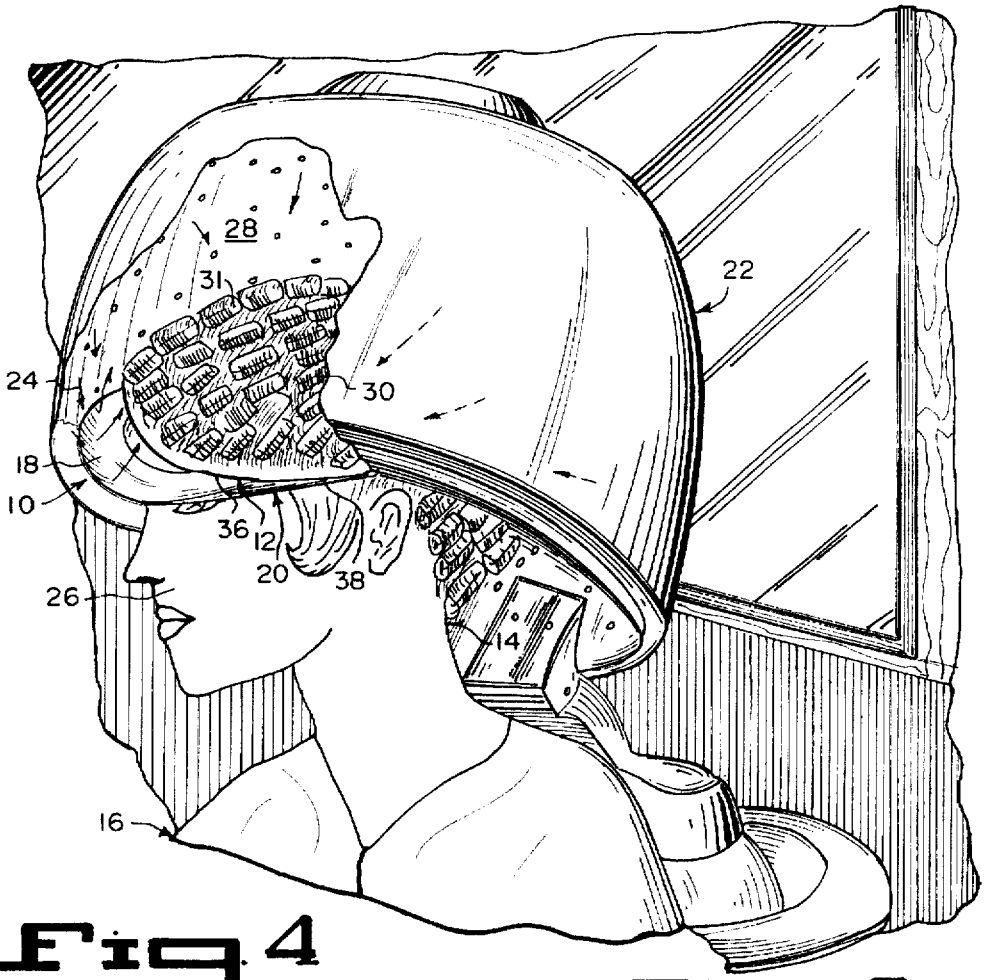

FIG. 4 is a front top perspective view of a person wearing the instant invention and sitting under a portable electric hair dryer with parts broken away, showing hot air deflected back into an air chamber of the hair dryer.

Figure 5:
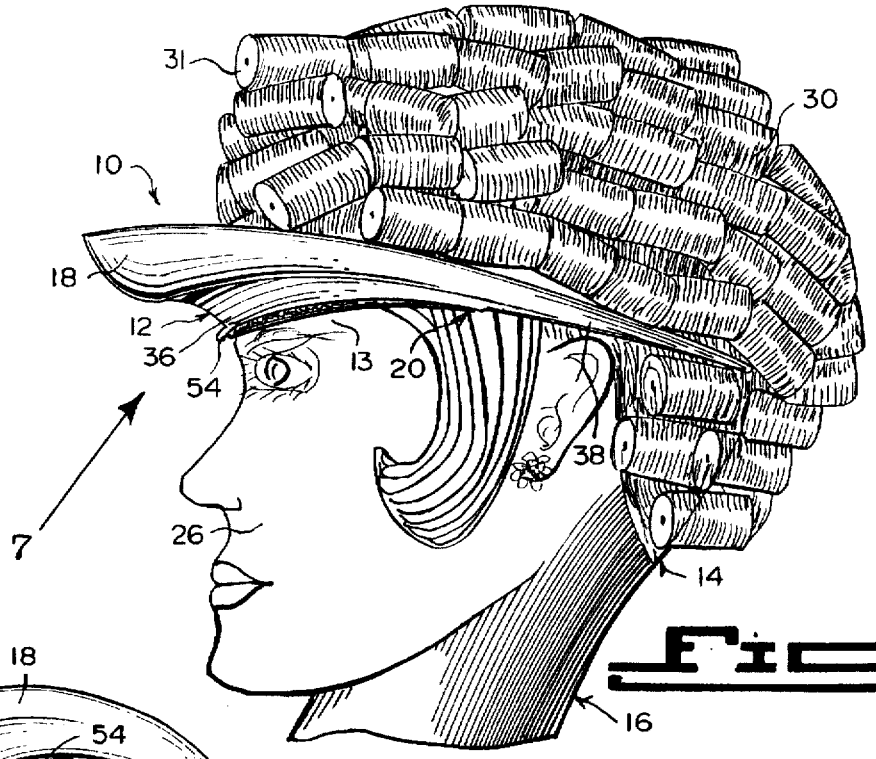

FIG. 5 is a side view taken in the direction of arrow 5 in FIG. 3.

Figure 6:
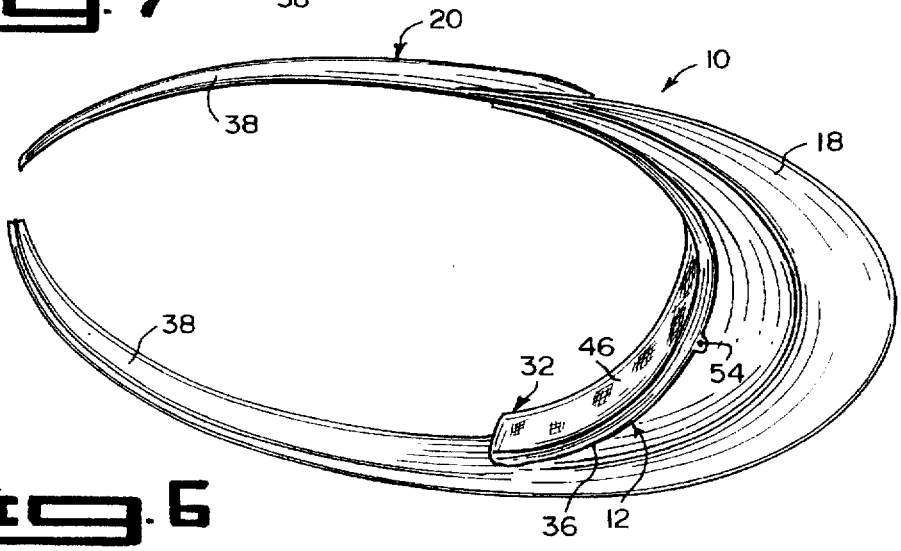

FIG. 6 is a rear bottom perspective view of the instant invention taken in the direction of arrow 6 in FIG. 1.

Figure 7:
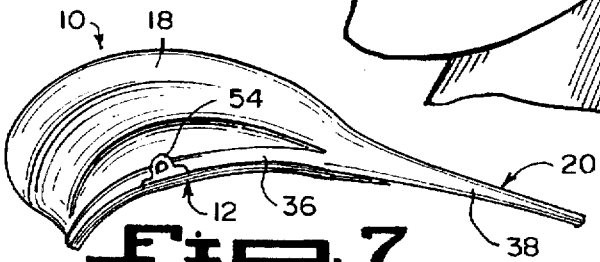

FIG. 7 is a front bottom perspective view of the instant invention taken in the direction of arrow 7 in FIG. 5.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 7 illustrate a heat protector visor 10 comprising an arcuate panel 12 to fit against a forehead 13 on a head 14 of a person 16. A bill 18 projects forwardly and curves upwardly from the arcuate panel 12. A structure 20 on the arcuate panel 12 is for gripping sides of the head 14 of the person 16. When the person 16 sits under a portable electric hair dryer 22, the upwardly curved bill 18 will deflect heated air 24 away from a face 26 of the person 16, back up into an air chamber 28 of the portable electric hair dryer 22 and onto hair 30 on hair rollers 31 upon the head 14 of the person 16. The heated air 24 will be maximized to dry the hair 30 much faster, reduce operating time and electricity needed to operate the portable electric hair dryer 22.

A facility 32 is for shielding the forehead 13 on the head 14 of the person 16 from the heated air 24 of the portable electric hair dryer 22. An assembly 34 is for attaching the shielding facility 32 to a rear surface of the arcuate panel 12 in a removable manner. The arcuate panel 12 is a front band 36 that covers the forehead 13 of the person 16.

The gripping structure 20 consists of a pair of tapered side pieces 38. Each tapered side piece 38 extends from one end of the arcuate panel 12 and engages with the side of the head 14 of the person 16. The arcuate panel 12, the upwardly curved bill 18 and the gripping structure 20 are all integral and fabricated out of a durable plastic material 40.

The shielding facility 32 is a heat insulator pad 42. The heat insulator pad 42 comprises a rectangular foam rubber member 44. A fabric covering 46 is about the rectangular foam rubber member 44.

The attaching assembly 34, as best seen in FIG. 2*a*, includes two mating VELCRO fastener strips 48 and 50. One VELCRO fastener strip 48 is affixed to the rear surface of arcuate panel 12. The other VELCRO fastener strip 50 is affixed to a wide surface of the fabric covering 46 of the heat insulator pad 42.

A hooked flange 52 is integral with and projects rearwardly on a top edge of the arcuate panel 12. The hooked flange 52 can engage with a top edge of the shielding facility 32, when the attaching assembly 34 holds the shielding facility 32 against the rear surface of the arcuate panel 12.

A hanger loop 54 is affixed to the center of the arcuate panel 12 below the upwardly curved bill 18. A person 16 can grasp the hanger loop 54 when the shielding facility 32 is to be disengaged from and engaged to the rear surface of the arcuate panel 12. The hanger loop 54 can also be utilized to hang up the heat protector visor 10 when not in use.

OPERATION OF THE INVENTION

To use the heat protector visor 10, the following steps should be taken:

1. Grasp the hanger loop 54 by one hand.
2. Press the second VELCRO fastener strip 50 on the shielding facility 32 against the first VELCRO fastener strip 48.
3. Make sure that hooked flange 52 engages with a top edge on the shielding facility 32.
4. Place the arcuate panel 12 against the forehead 13 of the head 14 of the person 16.

5. Position the tapered side pieces 38 to the side of the head 14 of the person 16.
6. Sit under the portable electric hair dryer 22.
7. Let the heated air 24 deflect off of the upwardly curved bill 18 and go back up into the air chamber 28 and then onto the hair 30 on the hair rollers 31.

LIST OF REFERENCE NUMBERS

10 heat protector visor
12 arcuate panel of 10
13 forehead of 14
14 head of 16
16 person
18 upwardly curved bill of 10 on 12
20 gripping structure of 10 on 12
22 portable electric hair dryer
24 heated air
26 face of 16
28 air chamber in 22
30 hair on 14
31 hair roller for 30
32 shielding facility of 10
34 attaching assembly for 32 on 12
36 front band for 12
38 tapered side piece of 20
40 durable plastic material for 12, 18 and 20
42 heat insulator pad for 32
44 rectangular foam rubber member of 42
46 fabric covering of 42 on 44
48 first VELCRO fastener strip of 34
50 second VELCRO fastener strip of 34
52 hooked flange on 12
54 hanger loop on 12

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A heat protector visor for recirculating hot air from an electric hair dryer comprising:

a) an electric hair dryer for directing hot air on the head of a person;

b) an arcuate panel to fit against a forehead on a head of the person, said arcuate panel having a forwardly facing front surface and a rear surface facing said forehead, said rear surface having a VELCRO fastening strip, a heat insulating pad having a front surface with a mating VELCRO fastening strip for attachment to said arcuate panel and a rear surface for resting on said forehead;

c) means comprising a bill projecting forwardly and curving upwardly from said arcuate panel for recirculating hot air from said dryer back up into an air chamber of said electric hair dryer;

d) means on said arcuate panel for gripping sides of the head of the person comprising a pair of tapered side pieces extending from said arcuate panel engaging the sides of the head of the person for supporting said panel on said forehead;

e) a hooked flange integral with and projecting rearwardly on a top edge of said arcuate panel engaging the top edge of said heat insulating pad; and f) means comprising a hanger loop affixed to the center of said arcuate panel below said upwardly curved bill to permit the person to remove said visor by grasping said hanger loop and pulling forward, and storing said visor by hanging the latter at said hanger loop.

* * * * *